United States Patent [19]

Schwaiger

[11] 4,215,785

[45] Aug. 5, 1980

[54] BABY FEEDING BOTTLE

[76] Inventor: Josef Schwaiger, 902 NE. 115th, Seattle, Wash. 98125

[21] Appl. No.: 22,730

[22] Filed: Mar. 22, 1979

[51] Int. Cl.[2] ..... A61J 9/00; A47K 41/02

[52] U.S. Cl. ..... 215/11 C; 215/13 R

[58] Field of Search ..... 215/11 R, 11 B, 11 D, 215/11 E, 12 R, 12 A, 13 R, 11 A, 11 C

[56] References Cited

U.S. PATENT DOCUMENTS

| | | | |
|---|---|---|---|
| 950,557 | 3/1910 | Paalen | 215/13 R |
| 1,354,712 | 10/1920 | Altenberg | 215/12 A |
| 1,448,996 | 3/1923 | Donath | 215/12 A |
| 1,744,498 | 1/1930 | Payson et al. | 215/13 R |
| 1,855,039 | 4/1932 | Wetmore | 215/13 R |
| 2,546,681 | 3/1951 | Searer | 215/11 B |
| 2,643,785 | 6/1953 | Rust | 215/13 R |
| 2,774,500 | 12/1956 | Budiani | 215/11 R |
| 2,833,436 | 5/1958 | Ruderian | 215/13 R |
| 2,981,430 | 4/1961 | Tsien | 215/13 R |
| 3,028,984 | 4/1962 | Bramming | 215/13 R |
| 3,039,639 | 6/1962 | Hassid | 215/13 R |
| 3,047,175 | 7/1962 | Bramming | 215/13 R |
| 3,373,888 | 3/1968 | Fuller | 215/13 R |
| 3,747,791 | 7/1973 | Fouser | 215/11 R |

*Primary Examiner*—Stephen Marcus

*Attorney, Agent, or Firm*—Delbert J. Barnard

[57] ABSTRACT

An upwardly tapering neck portion of an upper part of a housing for a vacuum-wall receptacle terminates in a thin circular lip which makes a line contact with the neck portion of the vacuum-wall receptacle. The neck portion of the upper part of the housing is relatively thin-walled and is distortable so that it can change shape if necessary to in that manner accommodate manufacturing differences in the vacuum-receptacle.

5 Claims, 6 Drawing Figures

Fig. 4
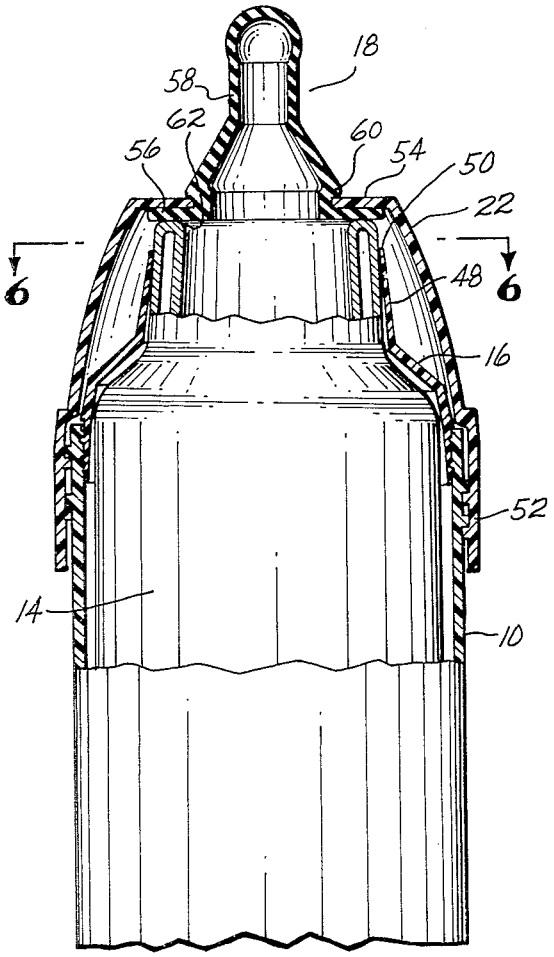
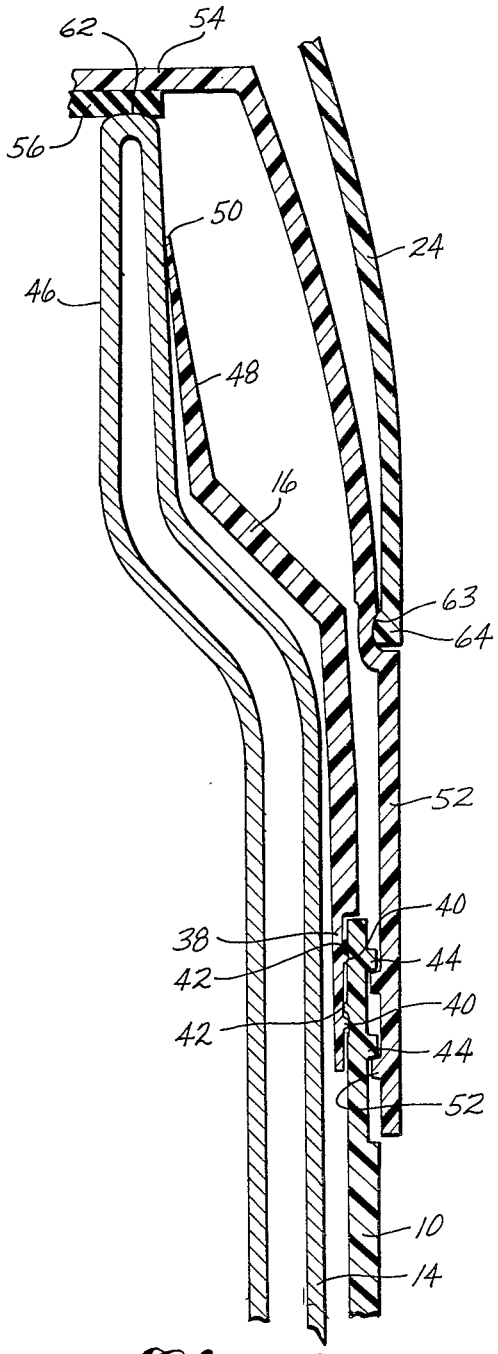
Fig. 5
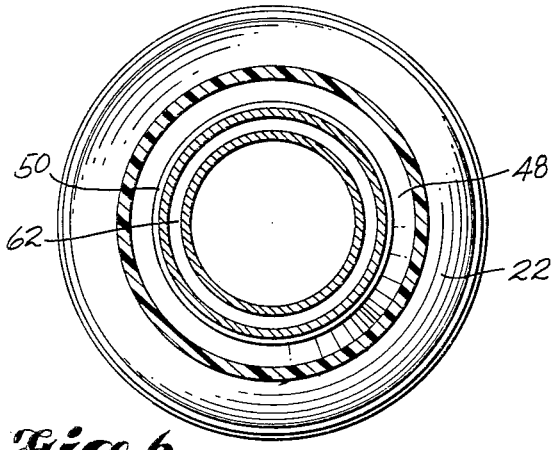
Fig. 6

BABY FEEDING BOTTLE

TECHNICAL FIELD

The present invention relates to a baby feeding bottle. More particularly, it relates to a baby feeding bottle that is constructed to keep its contents either warm or cold for a long period of time and which includes a vacuum-wall liner or insert.

BACKGROUND ART

The known prior art can be divided into four general catagories. Firstly, there are the conventional nursing bottles comprising a glass body and a nipple carrying cap which screws onto the upper end of the glass body. A typical example of this type of nursing bottle is disclosed by U.S. Pat. No. 2,808,167, granted Oct. 1, 1957 to Samuel Polazzolo.

Secondly, there are insulated containers for conventional baby nursing bottles. Examples of these are shown by U.S. Pat. No. 2,096,961, granted Oct. 26, 1937 to Bridget D. Condon, and by the aforementioned U.S. Pat. No. 2,808,167.

Thirdly, there are the well known thermos or vacuum type insulated bottles. Examples of these are disclosed by U.S. Pat. No. 1,388,189, granted Aug. 23, 1921, to George S. Meikle; by U.S. Pat. No. 2,833,436, granted May 6, 1958, to Max J. Ruderian and by U.S. Pat. No. 3,910,441, granted Oct. 7, 1975 to Carl Bramming.

Fourthly, there are baby nursing bottles which include a vacuum-wall receptacle of the type which is used in the aforementioned thermos or vacuum type insulated bottles. Examples of these are disclosed by U.S. Pat. No. 1,749,432, granted Mar. 4, 1930, to Elizabeth Kriege, and by U.S. Pat. No. 2,643,785, granted June 30, 1953, to Leonard W. Rust, Sr.

The bottle disclosed by Kriege, U.S. Pat. No. 1,749,432, does not employ a conventional nipple and both it and the bottle disclosed by Rust, Sr., U.S. Pat. No. 2,643,785, utilize resilient rubber materials or the like for centering the vacuum bottle within the outer housing or casing. These materials can readily absorb milk, dirt and other substances, are not easy to clean, and if frequently subjected to wash water will deteriorate over a short period of time.

SUMMARY OF THE INVENTION

According to the present invention, the body portion of a facuum-wall receptacle is located within a lower part of an outer housing or casing. The housing includes an annular upper part having a base end which is detachably connected to the lower part of the housing and a frustoconical neck portion which surrounds a frustoconical neck portion of the vacuum-wall receptacle. The neck portion of the upper part of the housing terminates in a circular lip which contacts the neck portion of the vacuum-wall receptacle at a side location closely below an annular end surface which surround the mouth of the vacuum-wall receptacle. The neck portion of the upper part of the housing is relatively thinwalled and distortable so that it can change shape if necessary to in that manner accomodate manufacturing differences in the vacuum-wall receptacle.

According to the invention, a conventional baby bottle nipple is secured in place by a cup-like member which includes a lower end which is connected to the lower part of the housing. A nursing portion of the nipple projects through a central opening in an upper end wall portion of such member. A flat annular portion of the upper end wall contacts the base flange of the nipple, and when such member is firmly secured to the lower portion of the housing the flange portion of the nipple is clamped firmly between such annular wall portion and the annular upper end surface of the vacuum-wall receptacle.

According to an aspect of the invention, the lower end of the upper part of the housing extends into the lower part of the housing and is connected thereto by means of complementary snap connector elements formed on the outer surface of the upper part of the housing and on the inner surface of the lower part of the housing.

According to another aspect of the invention, the cup-like nipple retaining member is secured to the lower part of the housing by means of complementary threads formed on an upper outer surface portion of the lower part of the housing and on the lower inner surface portion of the nipple retaining member.

According to still another aspect of the invention, the vacuum-wall receptacle is centered within the outer housing by means of contact between its upper neck portion and the circular lip at the upper end of the frusto-conical neck portion of the upper part of the housing, and at its lower end by means of a molded plastic support pedestal which sits on the bottom part of the lower part of the housing.

Of course, there are other features of the illustrated embodiment which constitute important parts of the invention. These features are set forth in detail below, as a part of the description of the illustrated embodiment. Accordingly, this summary, the description of the illustrated embodiment and the appended claims all together constitute a description of the invention.

BRIEF DESCRIPTION OF THE DRAWINGS

FIG. 4 is a fragmentary view of the upper portion of such baby feeding bottle, with a part thereof shown in longitudinal section, said view showing the nipple upright in a feeding position;

FIG. 5 is an enlarged scale fragmentary view of an upper portion of the baby feeding bottle, showing the manner in which the upper part of the housing and the cup-like nipple retaining member are secured to the lower part of the housing, and showing a relationship between the upper end portion of the upper part of the housing and the upper end of the vacuum-wall receptacle, for centering the vacuum-wall receptacle within the housing; and FIG. 6 is a cross-sectional view taken substantially along line 6—6 of FIG. 4.

DESCRIPTION OF THE PREFERRED EMBODIMENT

Figure 1:
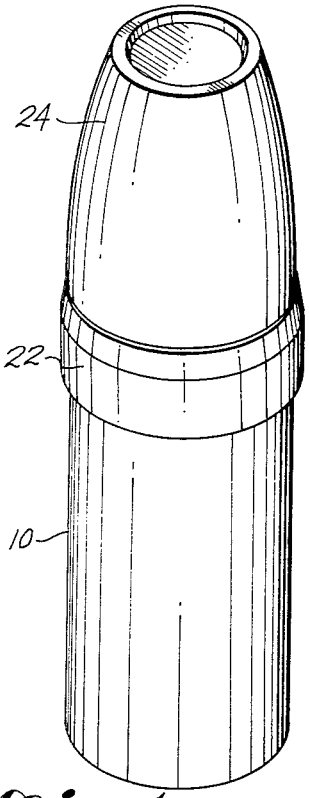
FIG. 1 is a pictorial view of a baby feeding bottle according to the present invention, with all parts thereof secured together.

The drawing figures show one embodiment of the invention which at the time of filing constituted the best known mode for carrying out the invention.

Figure 2:
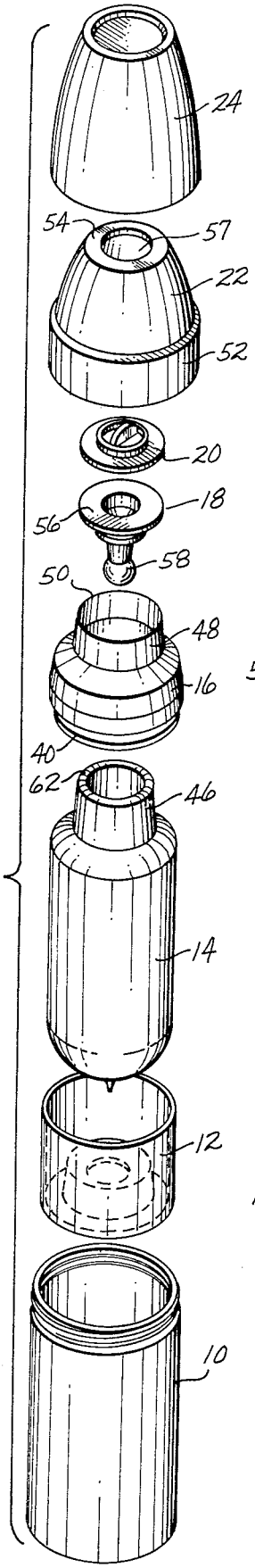
FIG. 2 is an exploded pictorial view of such a baby feeding bottle.

Referring first to FIGS. 1 and 2, the illustrated embodiment comprises a lower housing part 10, a centering and support pedestal 12, a vacuum-wall receptacle 14, an upper housing part 16, a nipple 18, a nipple cover 20, a cup-like nipple retaining member 22, and a cup-like cover or closure 24.

The receptacle 14 is constructed along the principles of the well-known Dewar flask or vessel. It is constructed from thin glass with two walls having a space between them which is evacuated so as to prevent the transfer of heat. The glass walls include a silver coating on the inside to reduce radiation. Herein this type of flask or vessel will be referred to as a "vacuum-wall receptacle."

One problem with handling vacuum-wall receptacles is that no two of them are manufactured to be exactly alike. They differ slightly in both dimension and shape. Whatever system is used for centering the vacuum-wall receptacle within its protective housing or casing must be capable of accomodating differences in manufacturing tolerance.

The centering mechanism 12 for the lower end of vessel 14 is preferably a unitary structure molded from a suitable plastic. It includes a cylindrical side wall 26 extending upwardly from a bottom 28 a sufficient distance so that its upper portion will be located between a lower outer side portion of vessel 14 and an adjacent side wall portion of the lower housing part 10. The member 14 is formed to include a pedestal 30 presenting a concave upper surface 32 which makes contact with a rounded or convex bottom surface of vessel 14. Pedestal 30 is formed to include an open center 34 for receiving the glass closure plug for the vacuum space between the two walls of the receptacle 14. As will be evident the member 12 both protects the bottom of the receptacle 14 and helps to center the receptacle 14 within the lower housing part 10.

One of the important features of the illustrated embodiment is that the vacuum bottle is close in weight to a standard glass baby bottle of like capacity. It is also close in length and diameter dimensions to a conventional glass baby bottle. This is made possible in large part by the manner in which the upper part of the housing and the nipple retaining member are arranged relative to each other, to the receptacle 14, and to the lower housing part 10, and to the manner to which they are both secured to the lower housing part 10.

As best shown by FIGS. 5 and 6, the inner upper portion of housing part 10 includes a recess in which a depending flange portion 38 at the lower or base end of housing part 16 is received. A pair of axially spaced apart, radially outwardly directed ridges 40 are formed on the flange 38 and are designed to "snap" passed a pair of radially inwardly projecting ridges formed on the upper inner surface portion of housing part 10 when housing part 16 is moved axially relatively into the housing part 10. The ridges 40, 42 constitute complementary snap connector elements and provide a way of connecting the two housing parts 10, 16 together without occupying much space. The lap joint formed where housing parts 10, 16 fit together is only slightly thicker than the individual wall thickness of parts 10, 16 both above and below it. In other embodiments the snap connector elements may be replaced by a screw thread connection.

A set of external threads 44 are formed on the upper outer surface portion of housing part 10 to be engaged by complementary internal threads formed on the lower inner portion of nipple retainer member 22.

The above described arrangement results in the lower portion of housing part 16 constituting a substantial continuation of the side wall of part 10 and the nipple retaining member 22 adding only a small addition to the width dimension to the bottle in its extent above housing part 10. It also results in the outer surface of the receptacle 14 being relatively close to, but still spaced from, the inner surfaces of the housing parts 10, 16, except at the very upper end of the housing part 16, where contact is desired and does in fact occur.

The upper or neck portion 46 of the receptacle 14 is frusto-conical in shape and it slopes inwardly as it extends upwardly. The same is true of the upper or neck portion 48 of upper housing part 16, except that it slopes inwardly at a steeper angle. As a result, the only contact which occurs is at the very upper or tip end of portion 48, where lip 50 may make a circular line of contact with the adjoining outer surface portion of the receptacle 14, depending on the trueness of the surface. Frusto-conical part 48 is tappered in the upward direction so that the lip is thin enough to distort and adapt itself to varying surface shapes which it might encounter.

The nipple retaining member 22 includes a cylindrical lower portion 50 in which internal threads 52 are provided for engaging the external threads 44 which are on housing part 10. Member 22 is cup-like and includes annular, flat upper end wall 54 surrounding a central nipple receiving opening 56 (FIG. 2).

The nipple 18 is a conventional baby bottle nipple and may be like the nipple that is manufactured by the Pyramaid Rubber Co., of Ravenna, Ohio, and sold under the trademark "Evenflo", and advertised as being patented in the United States. Such nipple includes a flat base or flange portion 56, an upstanding nursing portion 58, and a plurality of holding lugs 60 spaced circumferentially about the base of nursing portion 58, in a space relationship from the flange 56.

Figure 3:
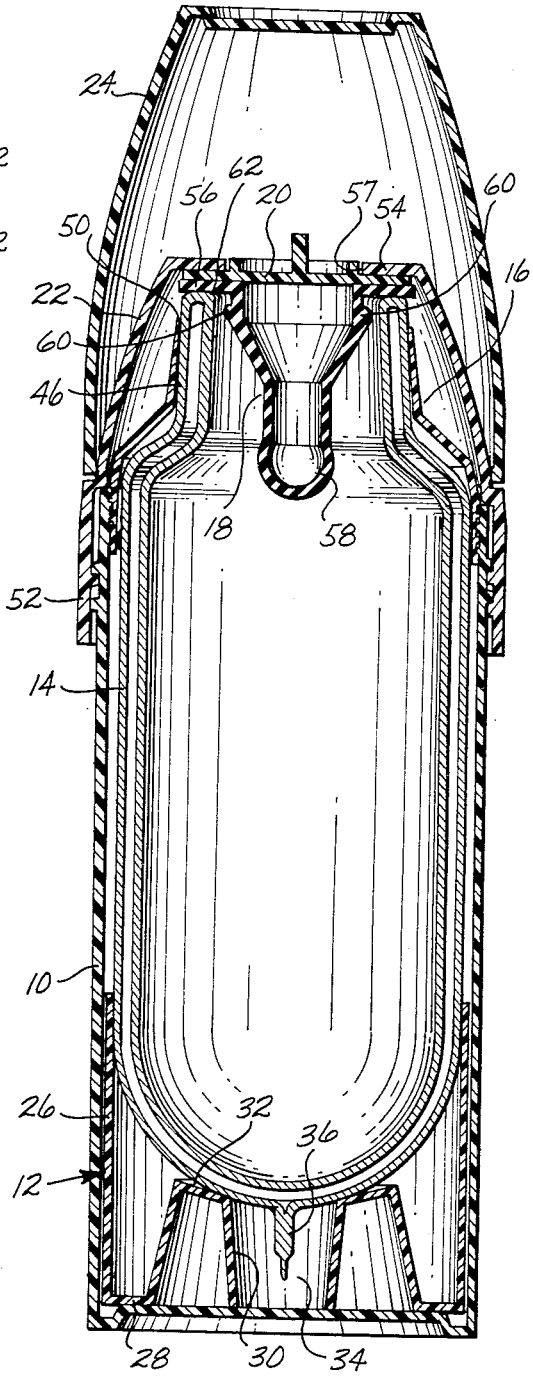
FIG. 3 is a longitudinal sectional view of such baby feeding bottle showing the nipple in an inverted position.

FIG. 3 shows the nipple 28 in an inverted position, wherein the nursing portion 58 thereof extends into the receptacle 14 while the flange 56 rests on the annular upper end surface 62 of receptacle 14. A lid 20, which is also convention per se, sets on the flange portion 56 of the inverted nipple 18 and the annular wall 54 of nipple retaining member 22 makes contact with an annular peripheral portion of member 20.

FIG. 4 shows the nipple 18 uprighted into a feeding position. The lower surface of the nipple flange 56 is seated on the annular surface 56. The inner edge of annular wall 54 is engaged between the upper surface of flange 56 and the lugs 60, this arrangement serving to secure the nipple 18 to the member 22. The member 22 is then screwed onto housing part 10 until tight. The nipple flange 56 is compressed between annular wall 54 and annular end surface 62, providing a seal against leakage of the contents of receptacle 14 at that location. The threaded connection 44, 52 provides an easy way of compensating for length differences in the receptacles 14.

The generally domed upper portion of member 22 is offset inwardly from the cylindrical portion 50 and a girth groove 62 is provided to make a snap fit connection with an inwardly directed girth ridge formed at the lower end of a cup-like closure or cap 24. As a result of the aforementioned offset, the wall of cap 24 is substantially an upwardly continuation of cylindrical wall 50.

Preferably, all of the parts with the exception of the nipple 18 and the glass receptacle 14 are injection molded from a light weight, durable plastic material which will not obsorb dirt or odors and which can be easily washed. A preferred plastic is Petrothene LS 606-00, a known food-proof plastic.

What is claimed is:

1. In a baby feeding bottle of a type comprising a vacuum-wall receptacle having a body portion and a frusto-conical neck portion defining a mouth and including an annular end surface surrounding said mouth; a housing for said vacuum-wall receptacle comprising a lower part in which the body portion of the vacuum-wall receptacle is received, said lower part including an open upper end beyond which the neck portion of said vacuum-wall receptacle extends, and an annular upper part having a base end which is detachably connected to the lower part of said housing; a nipple including a base flange which during use is seated on the annular end surface of the vacuum-wall insert, and an upstanding nursing portion; and a cup-like nipple retaining member which surrounds the upper part of said housing and includes a lower end which is connected to the lower part of said housing, and an upper end which includes a central opening through which the nursing portion of the nipple projects and an annular upper end wall which extends about said opening and makes clamping contact with the base flange of said nipple, the improvement characterized by said upper part of the housing being constructed from a light weight, durable, washable plastic material of a type that will not absorb dirt or odors, and comprising a frusto-conical neck portion which surrounds the neck portion of the vacuum-wall receptacle and includes a frusto-conical inner surface which extends at a slope which is greater than the slope of the outer surface of the frusto-conical neck portion of the vacuum-wall receptacle, said neck portion tapering upwardly and terminating in a thin circular lip which makes a line contact with the neck portion of the vacuum-wall receptacle at a side location closely below said annular end surface, and wherein the neck portion of the upper part of said housing is relatively thin-walled and is distortable so that it can change shape if necessary to in that manner accommodate manufacturing differences in the vacuum-wall receptacle.

2. A baby feeding bottle improvement according to claim 1, wherein the lower part of the housing and the nipple, retaining member are also constructed from a light weight washable plastic of a type that will not absorb dirt or odors, wherein the nipple retaining member is secured to the lower part of the housing by means of complementary threads formed on an upper outer surface portion of the lower part of the housing and on a lower inner surface portion of the nipple retaining member, such that when the nipple retaining member is screwed onto the lower part of the housing the base flange of the nipple is compressed between the upper end wall of the retaining collar and the annular end surface of the vacuum-wall receptacle, and wherein the lower end of the upper part of the housing extends into the lower part of the housing and is connected thereto by means of complementary connector elements formed on the outer surface of the upper part of the housing and on the inner surface of the lower part of the housing.

3. A baby feeding bottle improvement according to claim 2, wherein the lower end of the upper part of the housing extends into the lower part of the housing in slip-joint fashion and the complementary connector elements are snap connector elements.

4. A baby feeding bottle improvement according to claim 1, further comprising a support pedestal for the lower end of the vacuum-wall receptacle which is also constructed from a light weight, durable washable plastic material and which does not absorb dirt or odors and which is positioned within the lower part of the housing, said support pedestal including a side wall portion which extends between a side wall portion of the lower part of the housing and a lower portion of the vacuum-wall receptacle, and a central support portion which contacts a bottom portion of the vacuum-wall receptacle.

5. A baby feeding bottle improvement according to claim 1, further comprising a cup-like cover for the nipple having a closed upper end and an open lower end which is detachably connected to the nipple retaining member.

* * * * *